US009845952B2

(12) United States Patent
Tolvanen

(10) Patent No.: US 9,845,952 B2
(45) Date of Patent: Dec. 19, 2017

(54) ARRANGEMENT AND METHOD IN ELECTRIC FILTER

(71) Applicant: Valmet Technologies Oy, Espoo (FI)

(72) Inventor: Juha Tolvanen, Tampere (FI)

(73) Assignee: VALMET TECHNOLOGIES OY, Espoo (FI)

( * ) Notice: Subject to any disclaimer, the term of this patent is extended or adjusted under 35 U.S.C. 154(b) by 81 days.

(21) Appl. No.: 14/410,646

(22) PCT Filed: Jun. 26, 2013

(86) PCT No.: PCT/FI2013/050700
§ 371 (c)(1),
(2) Date: Dec. 23, 2014

(87) PCT Pub. No.: WO2014/001638
PCT Pub. Date: Jan. 3, 2014

(65) Prior Publication Data

US 2015/0323178 A1 Nov. 12, 2015

(30) Foreign Application Priority Data

Jun. 28, 2012 (FI) ..... 20125741

(51) Int. Cl.
*B03C 3/80* (2006.01)
*B03C 3/70* (2006.01)
(Continued)

(52) U.S. Cl.
CPC ..... *F23J 15/025* (2013.01); *B03C 3/70* (2013.01); *B03C 3/80* (2013.01); *B03C 3/34* (2013.01); *F23J 2217/102* (2013.01)

(58) Field of Classification Search
CPC combination set(s) only.
See application file for complete search history.

(56) References Cited

U.S. PATENT DOCUMENTS 2,867,182 A * 1/1959 Crites ..... F23K 1/00 110/165 R
4,411,204 A * 10/1983 Hamilton ..... F23C 9/003 110/106
(Continued)

FOREIGN PATENT DOCUMENTS

CN 201006482 Y 1/2008
CN 101792130 B 10/2011
(Continued)

OTHER PUBLICATIONS

Non-English Office Action with an English translation dated Mar. 29, 2016 for Chinese Application No. 201380033861.3.
(Continued)

*Primary Examiner* — Duane Smith
*Assistant Examiner* — Sonji Turner
(74) *Attorney, Agent, or Firm* — Ladas & Parry LLP

(57) ABSTRACT

An arrangement and method in connection with an electric filter of a boiler plant, the electric filter comprising an insulator chamber. The arrangement comprises a first scavenging duct for conveying warm scavenging gas to the insulator chamber. Said first scavenging duct is connected to a channel conveying process gas in the boiler plant, which means that it is possible to supply process gas to the insulator chamber.

12 Claims, 2 Drawing Sheets

(51) Int. Cl.
*F23J 15/02* (2006.01)
*B03C 3/34* (2006.01)

(56) References Cited

U.S. PATENT DOCUMENTS 4,602,573 A * 7/1986 Tanca ..... C10J 3/485 110/229
4,678,484 A 7/1987 Hartmann et al.
6,848,374 B2 * 2/2005 Srinivasachar ..... B01D 53/10 110/165 R
8,069,797 B2 * 12/2011 Srinivasachar ..... B01D 53/10 110/342
8,490,556 B2 * 7/2013 Yamada ..... F01K 13/00 110/204
9,360,211 B2 * 6/2016 Sugita ..... F23G 5/04
2004/0001788 A1 * 1/2004 Marin ..... B01D 53/32 423/210
2004/0244657 A1 * 12/2004 Srinivasachar ..... B01D 53/10 110/345
2005/0039598 A1 * 2/2005 Srinivasachar ..... B01D 53/10 95/134
2010/0236500 A1 * 9/2010 Douglas ..... F23C 7/002 122/22
2011/0048295 A1 * 3/2011 Yamada ..... F01K 13/00 110/341
2014/0041562 A1 * 2/2014 Grubbstrom ..... B01D 46/0067 110/345
2014/0069306 A1 * 3/2014 Sugita ..... F23G 5/04 110/224
2014/0216309 A1 * 8/2014 Gadgil ..... B01D 53/46 110/345

FOREIGN PATENT DOCUMENTS

EP 0237512 A1 9/1987
EP 2457637 A1 5/2012
FI 43179 B 11/1970

OTHER PUBLICATIONS

Espacenet English abstract of CN 201006482 Y.
Non-English Search Report dated Sep. 4, 2013 for Application No. PCT/FI2013/050700.
English Abstract of 101792130 B, published Oct. 5, 2011.

* cited by examiner

ARRANGEMENT AND METHOD IN ELECTRIC FILTER

RELATED APPLICATION INFORMATION

This application is a 371 of International Application PCT/F12013/050700 filed 26 Jun. 2013, which was published in the English language on 3 Jan. 2014, with International Publication Number WO 2014/001638 A1, which claims priority from Finnish Application No, 20125741 filed on 28 Jun. 2012, the disclosures of which are incorporated in their entirety by reference herein.

BACKGROUND

The invention relates to an arrangement in connection with an electric filter of a boiler plant, the electric filter comprising an insulator chamber and a first scavenging duct for conveying warm scavenging gas to the insulator chamber.

The invention further relates to a method in connection with an electric filter of a boiler plant, the electric filter comprising an insulator chamber and a first scavenging duct for conveying warm scavenging gas to the insulator chamber.

Electric filters are used, among other things, in removing particles from flue gases.

In the insulator chambers of electric filters, warm air scavenging is used as sealing air to protect electric insulators from dust and condensate. Scavenging air is heated with an electric heater to the required temperature that is 140° C., for example.

As the price of electricity increases, the costs of warm air scavenging have become a problem.

BRIEF DESCRIPTION

The arrangement and method of the invention are characterised by what is disclosed in the characterising parts of the independent claims. Other embodiments of the invention are characterised by what is disclosed in the other claims.

Inventive embodiments are also disclosed in the specification and drawings of this application. The inventive contents of the application may also be defined in ways other than those described in the following claims. The inventive contents may also consist of several separate inventions, particularly if the invention is examined in the light of expressed or implicit sub-tasks or in view of obtained benefits or benefit groups. In such a case, some of the definitions contained in the following claims may be unnecessary in view of the separate inventive ideas. Features of the different embodiments of the invention may be applied to other embodiments within the scope of the basic inventive idea.

In the following, features of some embodiments of the invention are listed in a random order:

The insulator chamber of the electric filter is connected through the first scavenging duct to a channel conveying process gas in the boiler plant, which means that process gas can be supplied to the insulator chamber. The advantage is that the scavenging gas of the insulator chamber need not be separately heated.

The idea of an embodiment is that the process gas is secondary, tertiary or some other corresponding air of the boiler plant. The advantage is that at least one of the above-mentioned airs is at a temperature suitable for scavenging gas.

The idea of an embodiment is that the temperature of the process gas is in the range of 80 to 300° C. The advantage is that process gas need not be heated before it is fed into the insulator chamber.

The idea of an embodiment is that the arrangement comprises a heating device and a second scavenging duct that is connected between the heating device and insulator chamber, whereby the gas heated with the heating device can be conveyed to the insulator chamber as scavenging gas, and the second scavenging duct is connected to the insulator chamber through a valve arrangement arranged to open and close it. The advantage is that it is possible to supply gas heated with the heating device to the insulator chamber during the start-up phase of the boiler plant or some other phase when the boiler plant cannot provide suitably heated scavenging gas.

The idea of an embodiment is that the valve arrangement comprises a three-way valve which is arranged in the first scavenging duct with its third connection connected to a second scavenging duct, and the valve arrangement comprises control means for controlling said three-way valve and for changing the scavenging gas supply from the first scavenging duct to the second scavenging duct and vice versa. The advantage is that the source of the scavenging gas can be changed with simple and reliable means.

The idea of an embodiment is that during the start-up phase of a boiler plant, scavenging gas is supplied to the insulator chamber through a heating device and second scavenging duct, and after the boiler plant has reached its normal operation, the process gas of the boiler plant is changed to be the scavenging gas supplied to the insulator chamber. The advantage is that good-quality scavenging gas can be supplied to the insulator chamber.

BRIEF DESCRIPTION OF THE FIGURES

The arrangement and method are described in greater detail in the attached drawings, in which.

In the figures, the matter is shown simplified for the sake of clarity. Like reference numerals identify like elements in the figures.

DETAILED DESCRIPTION

Figure 1:
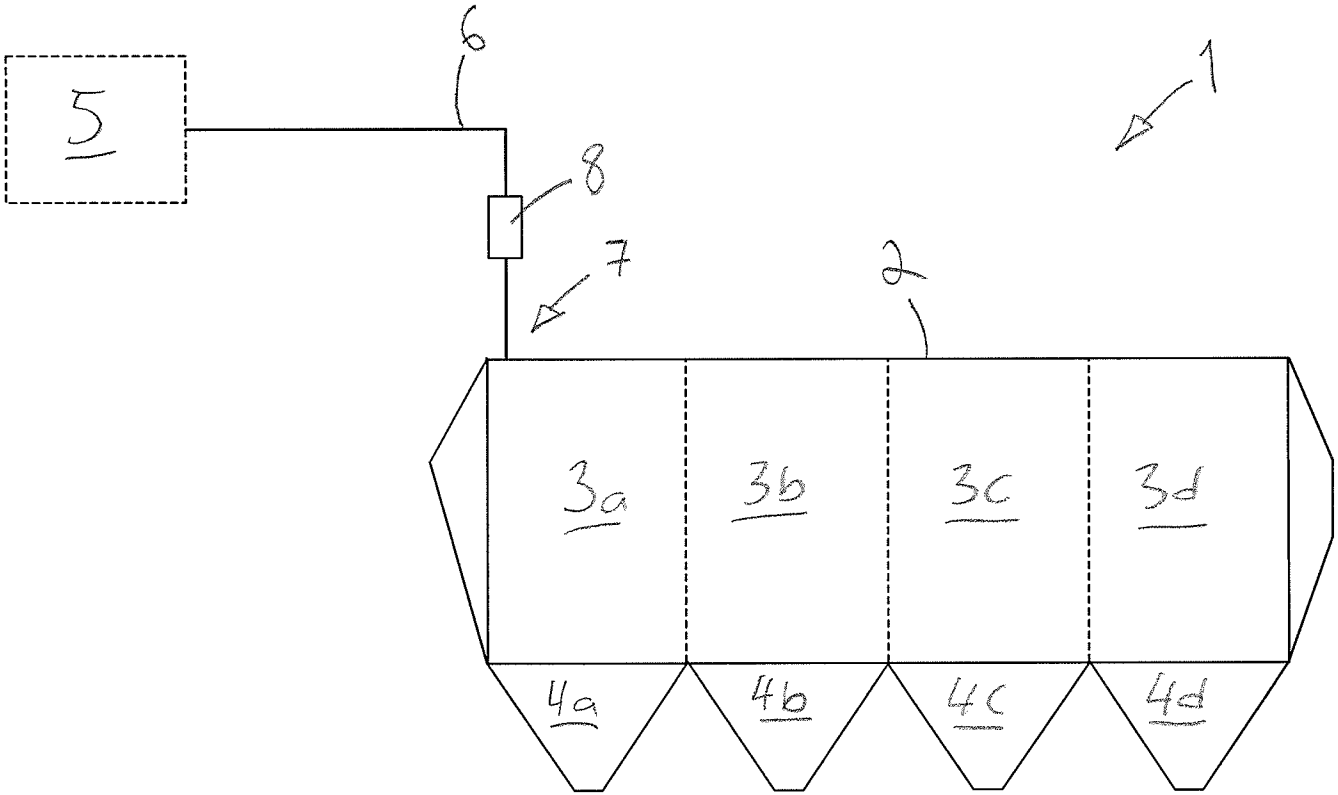
FIG. 1 is a schematic view of an arrangement and method.

FIG. 1 is a schematic view of an arrangement and method.

While electric filters are known, an arrangement for an electric filter 1 according to the present invention as shown in FIG. 1 comprises an insulator chamber 2, which in this case, is divided into four fields 3*a*, 3*b*, 3*c*, and 3*d*. Each field has a bottom funnel 4*a* to 4*d*, through which solid matter removed from the flue gases is also removed from the insulator chambers 2.

The electric filter 1 comprises numerous components and elements, such as electric isolators, supports, shakers, pressure transmitters that are not shown in the figures to simplify the presentation.

The task of the electric filter 1 is to purify the flue and product gases created as a result of a thermal process. In this context, the thermal process refers to the processing of fuel in a boiler plant by combustion, gasification or pyrolysis, for instance.

The boiler plant 5 may comprise one or more soda recovery boilers, bubbling fluidised-bed boilers (BFB), circulating fluidised-bed boilers (CFB), gas plants, pyrolysis plants, grate boilers or the like.

Process air or gas is used in the operation of the boiler plant 5. In this specification, the term process air is used later for process air and process gas.

Process air may be secondary or tertiary air or some other air needed in the combustion process of the boiler plant, for instance.

The arrangement comprises a first scavenging duct 6, through which suitable process air is fed as scavenging air into the insulator chamber 2. The scavenging duct 6 may be an element formed of a metal pipe or duct known per se. It may comprise a thermal insulation layer, for instance.

The first scavenging duct 6 is connected to the channel or chamber conveying the process air of the boiler plant 5. It should be noted that the connection between the scavenging duct 6 and the channel or chamber conveying the process air of the boiler plant 5 is not shown in the figures.

The first scavenging duct 6 is connected through a scavenging connection 7 to the insulator chamber 2. The temperature of the air conveyed as scavenging air to the insulator chamber 2 is preferably 80 to 300° C. The duct or chamber conveying the process air of the boiler plant 5, to which the first scavenging duct 6 is connected, preferably contains process air at a temperature within said temperature range.

The process air of one and the same boiler plant 5 can also be supplied to several insulator chambers 2. The first scavenging duct 6 could be constructed in such a manner, for instance, that is branches into several insulator chambers 2.

Measures that affect its characteristics can be directed to the air to be conveyed as scavenging air. For this purpose, the first scavenging duct 6 may comprise one or more regulating elements 8 of the scavenging duct. Such a regulating element may be a closing valve, for instance, with which the scavenging duct 6 can be closed, a regulating valve or damper or some other corresponding element for adjusting the flow rate or pressure of the scavenging air.

One advantage of the arrangement and method shown in FIG. 1 is that the process air need not, at least to a significant extent, be heated before it is fed into the insulator chamber 2, which means savings in energy costs. Another advantage is that the cost of implementing the arrangement and method is small.

The proportion of scavenging air in the process air of the boiler plant 5 is insignificant. The pressure of the process air in the boiler plant 5 is typically so high that a pressure-increasing pump need not necessarily be connected to the first scavenging duct 6.

Figure 2:
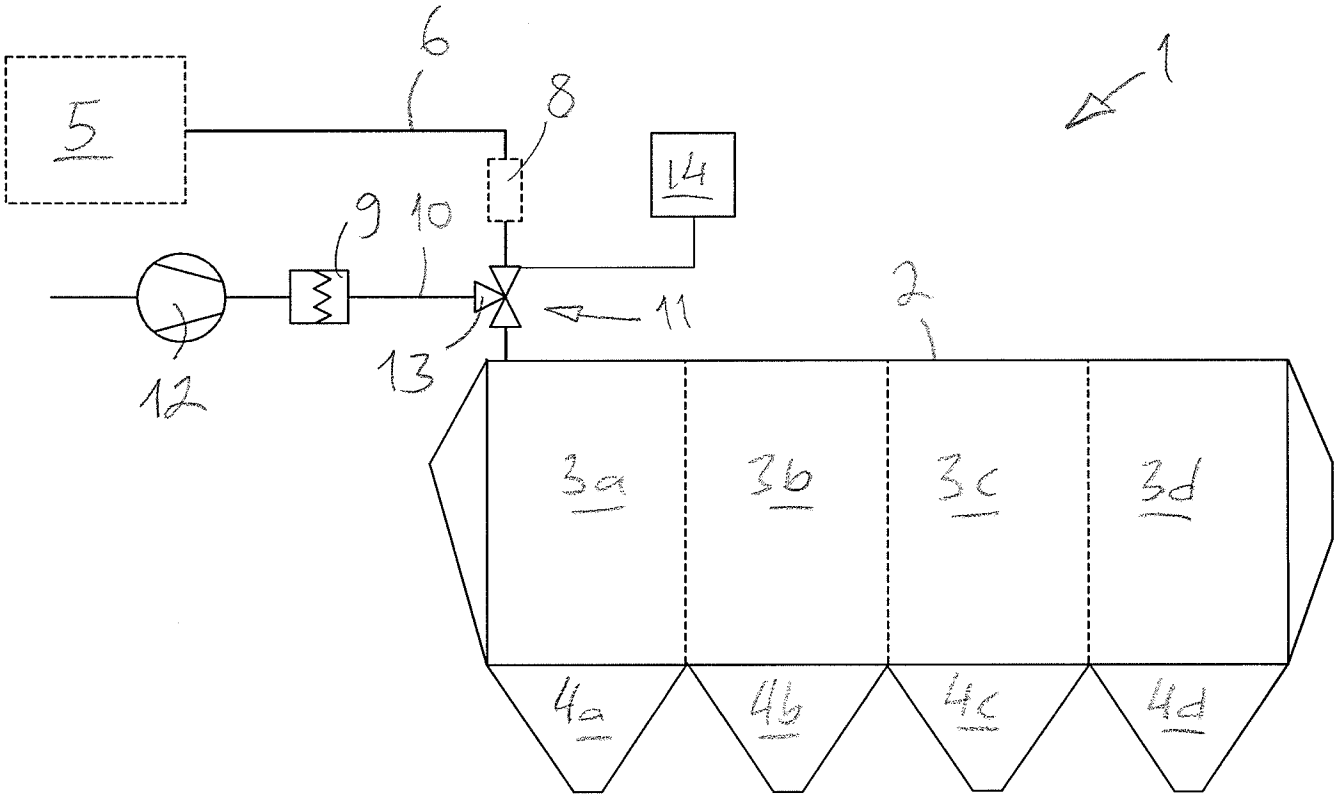
FIG. 2 is a schematic view of a second arrangement and method.

FIG. 2 is a schematic representation of a second arrangement and method that differs from that shown in FIG. 1 mainly in that the arrangement comprises a heating device 9 that is connected to the insulator chamber 2 through a second scavenging duct 10 and valve arrangement 11. The heating device 9 is an electrically operated heating device, for example.

It is possible to connect to the second scavenging duct 10 a fan 12 that supplies air to the insulator chamber 2 through the heating device 9, second scavenging duct 10 and valve arrangement 11. The fan pressurizes the air into a pressure of approximately 3000 Pa, for instance, and the heating device 9 heats it to a temperature of approximately 140° C., for instance.

The valve arrangement 11 is arranged to open and close the second scavenging duct 10 to the insulator chamber 2. In the embodiment shown in FIG. 2, the valve arrangement 11 comprises a three-way valve arranged in the first scavenging duct 6.

The second scavenging duct 10 is connected to the third connection 13 of the three-way valve. By adjusting the three-way valve, it is possible to change the source of scavenging air between the air arriving from the boiler plant 5 through the first scavenging duct 6 and the air arriving from the heating device through the second scavenging duct 10.

To control its operation, the valve arrangement 11 is equipped with control means 14.

During the start-up of the boiler plant 5, that is, before it has reached its normal operating status, process air suitable for scavenging air is not necessarily available. According to an idea, the control means 14 are arranged to control the valve arrangement 11 so that during the start-up phase of the boiler plant 5, scavenging air heated by the heating device 9 is fed to the insulator chamber 2 from the second scavenging duct 10. After the boiler plant 5 has reached its normal drift, process air of the boiler plant from the first scavenging duct is changed to be the scavenging air fed to the insulator chamber 2. The heating device 9 and fan 12 are then most preferably shut down to minimize their energy consumption.

An advantage of the arrangement and method shown in FIG. 2 is, among other things, that the supply of scavenging air of suitable quality can be assured in all phases regardless of the status of the boiler plant 5 and that the consumption of electricity can be decreased to a significant extent.

In some cases, features disclosed in this application may be used as such, regardless of other features. On the other hand, when necessary, features disclosed in this application may be combined in order to provide various combinations.

In summary, the arrangement of the invention is characterised in that:

said first scavenging duct is connected to a channel conveying process gas in the boiler plant, which means that process gas can be supplied to the insulator chamber. Further, the method of the invention is characterised by conveying process gas of the boiler plant to the insulator chamber for use as scavenging gas.

The drawings and the related description are only intended to illustrate the idea of the invention. It is apparent to a person skilled in the art that the invention is not restricted to the embodiments described above, in which the invention is described by means of some examples, but many modifications and different embodiments of the invention are possible within the scope of the inventive idea defined in the following claims.

REFERENCE NUMERALS

1 electric filter
2 insulator chamber
3*a* to *d* field
4*a* to *d* bottom funnel
5 boiler plant
6 first scavenging duct
7 scavenging connection
8 regulating elements of the scavenging duct
9 heating device
10 second scavenging duct
11 valve arrangement
12 fan
13 third connection
14 valve control means

The invention claimed is:

1. An electric filter of a boiler plant, the electric filter comprising:

an insulator chamber, and a first scavenging duct for conveying warm scavenging gas to the insulator chamber, said first scavenging duct being connected to a channel conveying process gas in the boiler plant such that the process gas is supplied to the insulator chamber as the warm scavenging gas, said process gas being secondary, tertiary, or some other corresponding air of the boiler plant.

2. The electric filter as claimed in claim 1, wherein the boiler plant is one of the following:

a soda recovery boiler, a bubbling fluidized-bed boiler, a circulating fluidized-bed boiler, a gas plant, a pyrolysis plant, and a grate boiler.

3. The electric filter as claimed in claim 1, wherein the temperature of the process gas is in the range of 80° to 300° C.

4. The electric filter as claimed in claim 2, wherein the temperature of the process gas is in the range of 80° to 300° C.

5. The electric filter of claim 1, further comprising:

a heating device, and a second scavenging duct that is connected between the heating device and the insulator chamber, whereby gas heated by the heating device is supplied to the insulator chamber as scavenging gas, the second scavenging duct being connected to the insulator chamber through a valve arrangement arranged to open and close the second scavenging duct.

6. The electric filter as claimed in claim 5, wherein the valve arrangement comprises:

a three-way valve arranged in the first scavenging duct with a third connection being connected to the second scavenging duct, and the valve arrangement further comprises control means for controlling said three-way valve and for changing the scavenging gas supply from the first scavenging duct to the second scavenging duct and vice versa.

7. A method for supplying scavenger gas to an insulator chamber of an electric filter of a boiler plant, the method comprising:

conveying warm scavenging gas from a first scavenging duct to the insulator chamber, wherein process gas of the boiler plant is used as the scavenging gas, and wherein the process gas is a secondary, tertiary, or some other corresponding air of the boiler plant.

8. The method of claim 7, wherein the process gas used as the scavenging gas is from one of the following boiler plants:

a soda recovery boiler, a bubbling fluidized-bed boiler, a circulating fluidized-bed boiler, a gas plant, a pyrolysis plant, and a grate boiler.

9. The method of claim 7, wherein the scavenging gas is conveyed to the insulator chamber at a temperature in the range of 80° to 300° C.

10. The method of claim 8, wherein the scavenging gas is conveyed to the insulator chamber at a temperature in the range of 80° to 300° C.

11. The method of claim 7, further comprising feeding scavenging gas to the insulator chamber through a heating device and a second scavenging duct during a start-up phase of the boiler plant, and after the boiler plant reaches normal operation, feeding process gas of the boiler plant as the scavenging gas to the insulator chamber.

12. The method of claim 11, further comprising conveying the scavenging gas to the insulator chamber through a three-way valve arranged in the first scavenging duct with a third connection being connected to the second scavenging duct, and controlling said three-way valve to change the scavenging air supply from the first scavenging duct to the second scavenging duct and vice versa.

* * * * *